United States Patent [19]

Heuser

[11] Patent Number: 4,909,221

[45] Date of Patent: Mar. 20, 1990

[54] INTERNAL COMBUSTION ENGINE FUEL INJECTION SYSTEM

[75] Inventor: Edgar Heuser, Bischofsheim, Fed. Rep. of Germany

[73] Assignee: General Motors Corporation, Detroit, Mich.

[21] Appl. No.: 271,564

[22] Filed: Nov. 15, 1988

[30] Foreign Application Priority Data

Nov. 19, 1987 [DE] Fed. Rep. of Germany ..... 3739108

[51] Int. Cl.[4] ..... F02M 39/00; B05B 15/00

[52] U.S. Cl. ..... 123/470; 123/456; 239/600

[58] Field of Search ..... 123/472, 468, 469, 470, 123/471, 456; 239/397.5, 533.2–533.12, 600

[56] References Cited

U.S. PATENT DOCUMENTS

| | | | |
|---|---|---|---|
| 1,687,672 | 10/1928 | Lang | 123/470 |
| 1,793,234 | 2/1931 | Mahler | 123/470 |
| 1,863,232 | 6/1932 | Woolson | 123/509 |
| 2,354,403 | 7/1944 | Reggio | 123/470 |
| 3,412,718 | 11/1968 | Long | 123/456 |
| 3,783,842 | 1/1974 | Kuhn | 123/469 |
| 3,845,748 | 11/1974 | Eisenberg | 123/468 |
| 3,924,583 | 12/1975 | Jardin | 123/469 |
| 4,143,625 | 3/1979 | Kulke | 123/470 |
| 4,286,563 | 9/1981 | Fahim et al. | 123/469 |
| 4,294,215 | 10/1981 | Hans | 123/469 |
| 4,485,790 | 12/1984 | Nishimura | 123/468 |
| 4,556,034 | 12/1985 | Anklam | 123/470 |
| 4,570,600 | 2/1986 | Atkins | 123/456 |
| 4,570,602 | 2/1986 | Atkins | 123/456 |
| 4,615,323 | 10/1986 | Leblanc | 123/509 |
| 4,693,223 | 9/1987 | Eshleman | 123/470 |

FOREIGN PATENT DOCUMENTS

| | | | |
|---|---|---|---|
| 3428597 | 2/1986 | Fed. Rep. of Germany . | |
| 1435462 | 3/1966 | France . | |
| 52-154921 | 12/1977 | Japan . | |
| 0070952 | 5/1982 | Japan | 123/470 |

OTHER PUBLICATIONS

"Search Results", Orbit Search Service, a Division of Maxwell Online, 06-12-89.

*Primary Examiner*—Carl Stuart Miller
*Attorney, Agent, or Firm*—C. K. Veenstra

[57] ABSTRACT

In an internal combustion engine fuel injection system, an injection valve has a connection to a fuel delivery pipe and a connection to the engine oriented at a right angle.

2 Claims, 1 Drawing Sheet

Fig.1
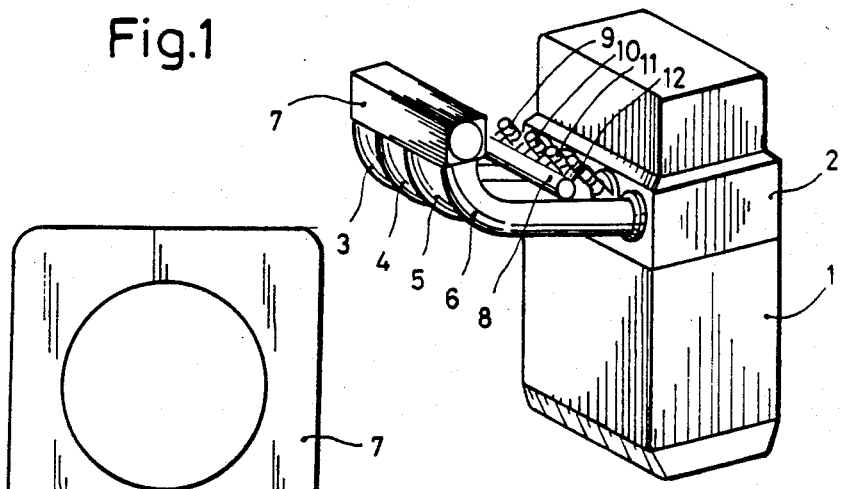
Fig.2
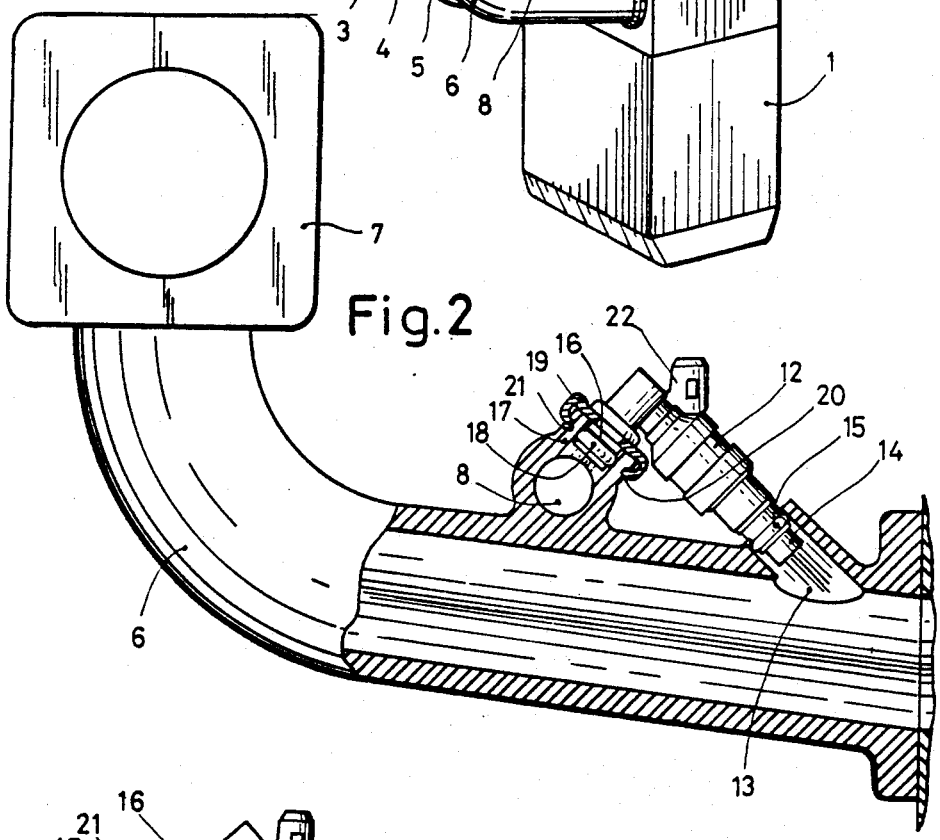
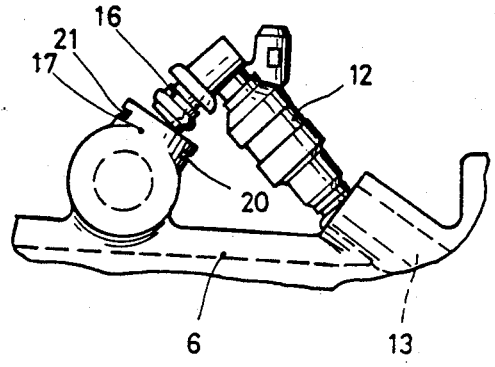
Fig.3

INTERNAL COMBUSTION ENGINE FUEL INJECTION SYSTEM

TECHNICAL FIELD

The invention relates to an internal combustion engine fuel injection system in which an injection valve can be inserted at one end into an intake manifold or a cylinder head of the engine and at the other end into a fuel delivery pipe.

BACKGROUND

In the internal combustion engine fuel injection system shown in DE No. 2908095, the injection valve is inserted into an opening in the fuel delivery pipe, and a locking clip retains the injection valve on the fuel delivery pipe. The assembly is then installed on the engine and the fuel delivery pipe is then attached to the engine with clips. In that system, the connection of the injection valve to the fuel delivery pipe is axially aligned with the connection of the injection valve to the engine.

Disadvantages of that system are the relatively large assembly effort, and the fact that in order to remove the injection valve, the fuel delivery pipe must be disassembled so that the injection valve can be withdrawn from the engine.

The invention is based on the task of configuring an internal combustion engine fuel injection system such that the injection valve can be removed and reinstalled without disassembling the fuel delivery pipe.

This task is performed, according to the invention, by the fact that the connection of the injection valve to the fuel delivery pipe is oriented at least approximately at right angles to the connection of the injection valve to the engine.

With this configuration, the injection valve, after being connected to the engine, can be connected to the fuel delivery pipe with a tilting motion. As a result, the fuel delivery pipe can be located permanently on the engine while the injection valve is inserted and later removed. It therefore becomes possible, by means of the invention, to replace an injection valve without disassembling the fuel delivery pipe.

As a result of the small number of parts, the production costs of this internal combustion engine fuel injection system are lower than that shown in DE No. 2908095, and better organization in the engine compartment results.

Production costs are particularly low if, according to another embodiment of the invention, the fuel delivery pipe is configured in one piece with the intake manifold. This eliminates the need for a separate fuel delivery pipe and the attachment parts required for it. This also results in high dimensional accuracy for the position of the injection valve, since both connections are made with a single component.

The invention admits of numerous embodiments. To further elucidate its basic principle, one embodiment is illustrated in the drawing and will be described below.

SUMMARY OF THE DRAWING

FIG. 1 shows a schematic perspective illustration of an internal combustion engine configured according to the invention.

FIG. 2 shows a partial section through an intake pipe of the internal combustion engine.

FIG. 3 shows a partial side view of the construction in FIG. 2, during installation of an injection valve.

THE PREFERRED EMBODIMENTS

FIG. 1 schematically shows an engine block 1 of a four-cylinder internal combustion engine, into the cylinder head 2 of which lead four intake pipes 3, 4, 5, 6 defining intake manifold runners which convey combustion air to the engine from an intake manifold plenum 7. A fuel delivery pipe 8, by means of which four injection valves 9, 10, 11, 12 are supplied with fuel, runs perpendicularly above the intake pipes 3, 4, 5, 6.

FIG. 2 shows, greatly enlarged compared to FIG. 1, the configuration of the engine in the region of the fuel delivery pipe 8 and of one injection valve 12.

FIG. 2 illustrates, using the example of the intake pipe 6, that the intake pipes 3–6 and the fuel delivery pipe 8 are configured as a one-piece cast part. Present in the intake pipe 6 on the engine block side in an opening 13, into which the injection valve 12, with an injection connector socket 14 at the injection end, is inserted. On this injection connector socket 14 in the seal 15, which seals the injection connector socket 14 in the opening 13, but allows the injection valve 12 to make a tilting motion.

The injection valve 12 has, at its end opposite the injection end, at right angles to the injection connector socket 14, an additional supply connector socket 16, which engages in a receiving socket 17 in the fuel delivery pipe 8 and is sealed there, again by means of an O-ring seal 18. A locking clip 19, C-shaped in cross section engages with each of its ends in slots 20, 21 on the outside of the receiving socket 17 and thus retains the injection valve 12 in this receiving socket 17.

With the injection valve 12, like the other injection valves 9, 10, 11, installed as shown, its electrical connector 22 shown in FIG. 2 is necessarily located on an easily accessible side.

FIG. 3 illustrates that the injection valves 9–12 are first inserted into the corresponding openings 13 of the respective intake pipes 3–6. As shown for the example of the injection valve 12, this brings its upper supply connector socket 16 into a position lying above the receiving socket 17. The injection valve 12 can be tilted downward, so that its supply connector socket 16 reaches into the receiving socket 17. FIG. 3 also illustrates the slots 20, 21 in the outer surface of the receiving socket 17. The locking clip 19 is not shown in this figure, however, since it is not installed until after the injection valve 12 has been inserted.

I claim:

1. An internal combustion engine fuel injection system having an injection valve which can be inserted by an injection connecting socket in sealing relationship in an opening of an engine, and by a supply connecting socket in sealing relationship in an opening in a fuel delivery pipe, characterized in that the injection connecting socket is aligned at least approximately at right angles to the supply connecting socket and the injection connecting socket pivots with respect to the axis of the engine opening to enable movement of the supply connecting socket in and out of the fuel delivery pipe opening when the injection connecting socket is inserted in the engine opening.

2. An injection valve, for an internal combustion engine fuel injection system, which can be inserted by an injection connecting socket in sealing relationship in an opening of an engine, and a supply connecting socket in sealing relationship in an opening in a fuel delivery pipe, characterized in that the injection connecting socket is aligned at least approximately at right angles to the supply connecting socket and the injection connecting socket pivots with respect to the axis of the engine opening to enable movement of the supply connecting socket in and out of the fuel delivery pipe opening when the injection connecting socket is inserted in the engine opening.

* * * * *